US007655867B2

(12) United States Patent
Schäfer

(10) Patent No.: US 7,655,867 B2
(45) Date of Patent: Feb. 2, 2010

(54) CONDUCTOR FOR LIQUID-COOLED WINDINGS

(75) Inventor: Michael Schäfer, Backnang (DE)

(73) Assignee: Siemens Aktiengesellschaft, Munich (DE)

( * ) Notice: Subject to any disclaimer, the term of this patent is extended or adjusted under 35 U.S.C. 154(b) by 333 days.

(21) Appl. No.: 10/595,197

(22) PCT Filed: Sep. 6, 2004

(86) PCT No.: PCT/DE2004/002010

§ 371 (c)(1),
(2), (4) Date: Feb. 12, 2007

(87) PCT Pub. No.: WO2005/031768

PCT Pub. Date: Apr. 7, 2005

(65) Prior Publication Data

US 2007/0277994 A1 Dec. 6, 2007

(30) Foreign Application Priority Data

Sep. 5, 2003 (DE) ..... 103 45 664

(51) Int. Cl.
*H01B 7/00* (2006.01)

(52) U.S. Cl. ..... 174/120 R

(58) Field of Classification Search ..... 174/120 R, 174/102 SP, 121 R, 121 B, 120 FP
See application file for complete search history.

(56) References Cited

U.S. PATENT DOCUMENTS

| | | | | |
|---|---|---|---|---|
| 4,088,830 | A * | 5/1978 | Wargin et al. | 174/113 R |
| 4,096,351 | A * | 6/1978 | Wargin et al. | 174/102 R |
| 4,675,474 | A * | 6/1987 | Neuroth | 174/102 R |
| 5,831,215 | A * | 11/1998 | Ziemek et al. | 174/108 |
| 6,657,122 | B1 | 12/2003 | Krenzer et al. | 174/49 |
| 2002/0029897 | A1 * | 3/2002 | Younsi et al. | 174/120 R |

FOREIGN PATENT DOCUMENTS

| | | | |
|---|---|---|---|
| DE | 1 287 684 | | 1/1969 |
| DE | 1 638 928 | | 8/1971 |
| DE | 2 316 830 | | 10/1974 |
| DE | 3823938 | * | 2/1990 |
| DE | 42 43 090 | C1 | 7/1994 |
| DE | 299 14 596 | U1 | 2/2000 |
| EP | 0 746 861 | | 12/1996 |
| EP | 0 959 550 | A2 | 5/1999 |
| EP | 1 079 500 | A1 | 7/2000 |
| WO | 94/07251 | | 9/1993 |
| WO | 95/30991 | | 5/1995 |

OTHER PUBLICATIONS

International Search Report for Application No. PCT/DE2004/002010 (3 pages), Nov. 5, 2005.

* cited by examiner

*Primary Examiner*—Chau N Nguyen
(74) *Attorney, Agent, or Firm*—King & Spalding L.L.P.

(57) ABSTRACT

A conductor for windings cooled by liquid, especially for transformer windings, has an insulating covering which surrounds the entire conductor (1). At least one layer (2) of the covering completely surrounds the conductor (1). An external layer (3) provided with at least two layers (2, 3) of the covering comprises openings (4), holes (5) or frays (6) through which a coolant flowing around the conductor is placed in a turbulent state and better heat exchange is obtained.

16 Claims, 2 Drawing Sheets

CONDUCTOR FOR LIQUID-COOLED WINDINGS

CROSS-REFERENCE TO RELATED APPLICATIONS

This application is a U.S. national stage application of International Application No. PCT/DE2004/002010 filed Sep. 6, 2004, which designates the United States of America, and claims priority to German application number 10345664.3 filed Sep. 25, 2003, the contents of which are hereby incorporated by reference in its entirety.

TECHNICAL FIELD

The invention relates to a conductor for liquid-cooled windings, in particular for transformer or inductor coil windings in accordance with the precharacterizing clause of the main claim. The invention also relates to a corresponding liquid-cooled transformer and a liquid-cooled inductor coil.

BACKGROUND

A winding, formed from a generic conductor, of an oil-filled transformer or similar electrical device having a relatively high power rating generally has cooling channels passing through it for the purpose of guiding a cooling liquid such as oil in order to dissipate heat which is incident owing to resistive losses. The heat produced in the conductor in this case needs to pass through an insulating sheathing, which is generally applied directly to the conductor and is typically produced from paper, and a boundary layer formed on a surface of this sheathing. In the process, a temperature gradient occurs both in the sheathing and in the boundary layer and there is thus a temperature difference between the conductor and the cooling liquid. At a given value for the heat to be dissipated, this temperature difference is a decisive variable for dimensions to be selected for the conductor and the corresponding winding.

In order to ensure sufficiently effective cooling, in particular larger dimensions therefore often need to be selected for windings having conductors according to the prior art than would be desirable. The documents EP 0746861 B1 and EP 1079500 A1 have disclosed conductors for transformer windings which comprise a plurality of conductor elements and have a perforated or net-like sheathing such that the corresponding cooling liquid can flow through the sheathing and, as a result, flow around the individual conductor elements. Although this achieves an improved cooling effect, this is at the expense of considerably impaired insulation of the respective conductor, in the case of which, instead of the conductor being insulated as a whole, only the individual conductor elements are insulated by a thin enamel coating. It is therefore only possible to use such conductors at relatively low voltages up to approximately 25 kV, since higher voltages require the conductor to be completely closed off by a sheathing.

SUMMARY

The invention is therefore based on the object of developing a conductor for liquid-cooled windings which allows for improved cooling even in the case of operation at relatively high voltages and thus makes it possible to design corresponding electrical devices with smaller dimensions.

This object can be achieved according to the invention by a conductor for liquid-cooled windings, in particular for transformer windings, comprising an insulating sheathing which surrounds the conductor as a whole, wherein at least one layer of the sheathing surrounds the conductor so as to cover it completely, and wherein an outer layer of at least two layers of the sheathing has openings, meshes or frayed sections.

At least one, preferably each layer of the sheathing can be formed by being wound around the conductor. At least one layer of the sheathing, preferably at least each layer apart from the outer layer can be made from paper. The outer layer can be made from perforated paper. The outer layer can be formed by a tape which is slit at regular intervals at one edge so as to form lugs protruding at the edge, the tape preferably being made from paper. The outer layer can be formed by a net or woven fabric, which is preferably made from a plastic. The net or the woven fabric may have individual meshes having a diameter of between 1 mm and 15 mm, preferably between 1.5 mm and 5 mm. The outer layer may have openings having a diameter of between 2 mm and 10 mm, preferably between 3 mm and 7 mm. The outer layer may cover a proportion of between 30% and 80% of the layer lying therebeneath. Owing to the layer or layers, which completely cover(s) the conductor, of the sheathing, a coating having a thickness of between 0.1 mm and 2 mm, preferably between 0.2 mm and 1 mm, is formed. A plurality of individual conductor elements, preferably between five and one hundred and ninety-eight conductor elements may be provided. The conductor may have a preferably rectangular cross section of between 0.2 $cm^2$ and 40 $cm^2$. A liquid-cooled transformer or liquid-cooled inductor coil may contain at least one winding comprising such a conductor. The transformer may comprise an oil surrounding the conductor, preferably mineral oil, or an ester liquid surrounding can be provided as the coolant.

As a result of the fact that the conductor has an insulating sheathing which surrounds it as a whole, in which case at least one layer of the sheathing surrounds the conductor so as to cover it completely, but at the same time an outer layer of in total at least two layers of the sheathing has openings, meshes or frayed sections, on the one hand effective electrical insulation of the conductor is achieved, and this conductor is thus also suitable for operation at very high voltages, and on the other hand a surface of the conductor or the sheathing of the conductor is achieved which is structured such that a cooling liquid flowing around the conductor or at least one boundary layer of this cooling liquid which is applied to the conductor is made turbulent. This results in a markedly improved heat exchange at the surface of the conductor, thereby improves the cooling effect by the cooling liquid flowing around the conductor and thus allows for a more compact design of liquid-cooled electrical devices having windings which are formed by such a conductor. In particular liquid-cooled inductor coils or transformers in which at least one, preferably each winding comprises a conductor of the described type can thus be implemented in an advantageous manner with smaller dimensions and/or a suitability for relatively high operating voltages compared with corresponding devices according to the prior art. The described advantage of improved cooling is in this case achieved although the cooling liquid cannot flow through the sheathing and, in the case of a design of the conductor comprising a plurality of conductor elements, can therefore also not flow individually around said conductor elements. In this document, frayed sections which the outer layer of the sheathing may have in place of or in addition to openings and/or meshes in order to produce turbulence are parts of said layer which protrude from the conductor in the form of lugs.

A layer of the sheathing of the conductor can be formed by the conductor having a flat material wound around it, preferably by it having a strip wound around it which surrounds the conductor in helical fashion. As a result, the sheathing or the corresponding layer of the sheathing can be produced in a very simple manner. It is of course also possible for a plurality of layers or all of the layers of the sheathing to be designed in this way. A material which is very suitable for a layer or a plurality of layers of the sheathing is paper, which has a good insulating effect, is inexpensive and is easy to manipulate owing to its high flexibility. In particular, the layer or layers which form a part of the sheathing which surrounds the conductor so as to cover it completely may each comprise one single paper strip.

The outer layer can also be made from paper in the case of an embodiment of a conductor according to the invention which can be produced in a very simple and inexpensive manner, which paper may be perforated so as to form the openings and, as a result, leads to a desired surface property for the conductor. In another, likewise simple embodiment of the invention, the outer layer comprises a tape which has been wound around the conductor in helical fashion and has an edge which has slits at intervals which are not too great such that this edge forms lugs or frayed sections which protrude from the conductor and influence the flow of cooling liquid in a desired manner. The intervals between individual slits in the tape, which may also vary, can contribute to a particularly good swirling effect, for example between a tenth and a fifth of a diameter of the conductor. It is also suitable in such an embodiment of the outer layer of the sheathing for said layer to be produced from paper.

Another, likewise simple implementation of the outer layer of the sheathing, which leads to the flow of the cooling liquid being advantageously influenced, results when a net or woven fabric is used for this layer. Such a net or woven fabric may be made from plastic or synthetic fibers, for example polyamide or nylon, in order to be sufficiently stable and not itself to be conductive. Owing to the meshes of this net or woven fabric, which may have, for example, diameters of in each case between 1 mm and 15 mm, in typical embodiments between 1.5 mm and 5 mm, depending on the viscosity of the cooling liquid used, in order to achieve the desired swirling effect, the conductor or the sheathing of the conductor is then provided with a surface structure which interrupts the boundary layer of the cooling liquid there and results in turbulences having corresponding typical size scales being produced.

In all of the embodiments of the invention described, in the process the flow of cooling liquid or its boundary layer is not only limited locally but is manipulated over the entire surface of the conductor and, as a result, better heat exchange is achieved not only locally but also over a large area. In the case in which the outer layer has a perforated design or a design provided with openings, this effect is particularly good if the openings have a diameter of between 2 mm and 10 mm; in the case of typical cooling liquids and flow rates, openings having a diameter of between 3 mm and 7 mm have proved to be optimal. A particularly homogenous influence on the flow, which favors extensive turbulence formation, is in turn achieved if the outer layer of the sheathing which is provided with openings or meshes covers a proportion of between 30% and 80% of the layer lying therebeneath, i.e. a proportion of the area of between 20% and 70% of the layer lying therebeneath remains uncovered by the openings or meshes. In an embodiment having an outer layer which is provided with frayed sections in the manner described previously, for the same reason it is advantageous to take care to ensure that successive protruding components of the outer layer are not spaced apart from one another by more than approximately the diameter of a conductor in the longitudinal direction of the conductor, as well.

Oils and ester liquids, in particular mineral oils and synthetic oils such as silicone oil, are particularly well suited as the coolant for windings which are formed by such conductors. These cooling liquids are characterized by a suitable viscosity and an expedient thermal resistance.

Sufficiently effective electrical insulation of the conductor even for operation at very high voltages can be ensured if the inner layer of the sheathing, which surrounds the conductor so as to cover it completely, or an inner coating of the sheathing, which may be formed from a plurality of layers and completely covers the conductor, has a thickness of between 0.1 mm and 2 mm. This layer or coating should not be any thicker than is necessary in order not to impair the cooling of the conductor more than necessary; for conventional applications, a thickness for this layer or coating of between 0.2 mm and 1 mm is a good compromise.

In preferred embodiments of conductors according to the invention, the conductor comprises a plurality of individual conductor elements, which are guided essentially parallel and may be twisted. The conductor as a whole is thus more flexible and is therefore easier to manipulate. One further advantage consists in a considerable reduction in eddy currents in the conductor and power and thermal losses associated therewith which is made possible thereby. As a result, the conductor not only gains more advantageous electrical properties, but also the cooling of the conductor is further simplified by the reduction in the incident heat and a resultant more compact design of a corresponding electrical device is possible. This effect can be achieved with little complexity if the conductor comprises between five and one hundred and ninety-eight conductor elements. In this case, the conductor may also be in the form of a twisted-pair conductor.

One embodiment according to the invention of conductors for liquid-cooled windings is particularly suitable for those conductors which have a cross section of between 0.2 $cm^2$ and 40 $cm^2$, but preferably not more than 16 $cm^2$, and as a result are suitable for operation at high voltages and high current levels which are generally associated therewith, but on the other hand still allow for effective cooling by means of a cooling liquid flowing around the conductor as a whole. Such conductors can be manipulated particularly well to form windings if they have a rectangular cross section, which can be implemented easily in particular in the case of a design comprising a plurality of conductor elements.

BRIEF DESCRIPTION OF THE DRAWINGS

Exemplary embodiments of the invention will be explained below with reference to FIGS. 1 to 3, in which.

DETAILED DESCRIPTION

Figure 1:
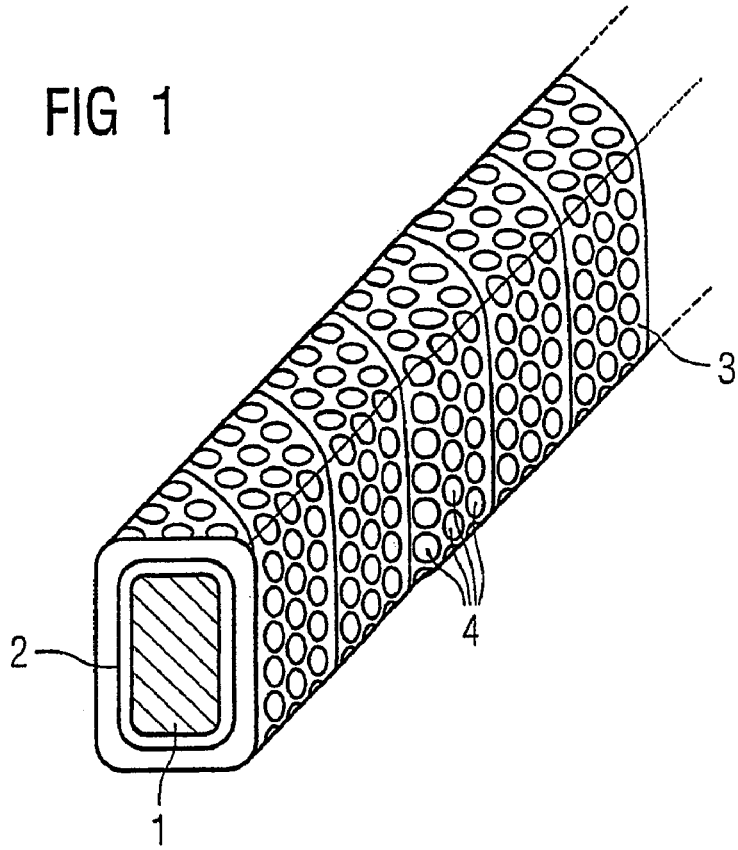
FIG. 1 shows a perspective illustration of one end of a conductor according to the invention.

FIG. 1 shows a conductor 1 which has a sheathing comprising an inner layer 2 and an outer layer 3. The inner layer 2 forms a conventional paper insulation, i.e. is implemented by paper being wound around and surrounds the conductor 1 such that it completely covers it. The outer layer 3, which likewise comprises a paper strip wound around the conductor, has a perforation formed by openings 4. These openings 4 have a diameter of approximately 4 mm and cover the outer layer 3 such that said outer layer 3 covers only approximately 60% of the inner layer 2 lying therebeneath. The conductor 1, which forms a winding of an oil-cooled transformer, or the sheathing of this conductor 1 is thus provided with a surface structure which makes a flow of a synthetic oil, used as the coolant, turbulent at least at this surface and, as a result, results in improved heat exchange and more effective cooling of the conductor 1. The conductor 1, which comprises thirty-five conductor elements, has a cross section of approximately 5.5 $cm^2$. Owing to the perforated design of the outer layer 3 of the sheathing of this conductor 1, very effective cooling of this conductor 1 is provided by the described effect, although the coolant cannot flow individually around the conductor elements of the conductor 1 owing to the insulating inner layer 2, which has a thickness of approximately 0.5 mm.

Figure 2:
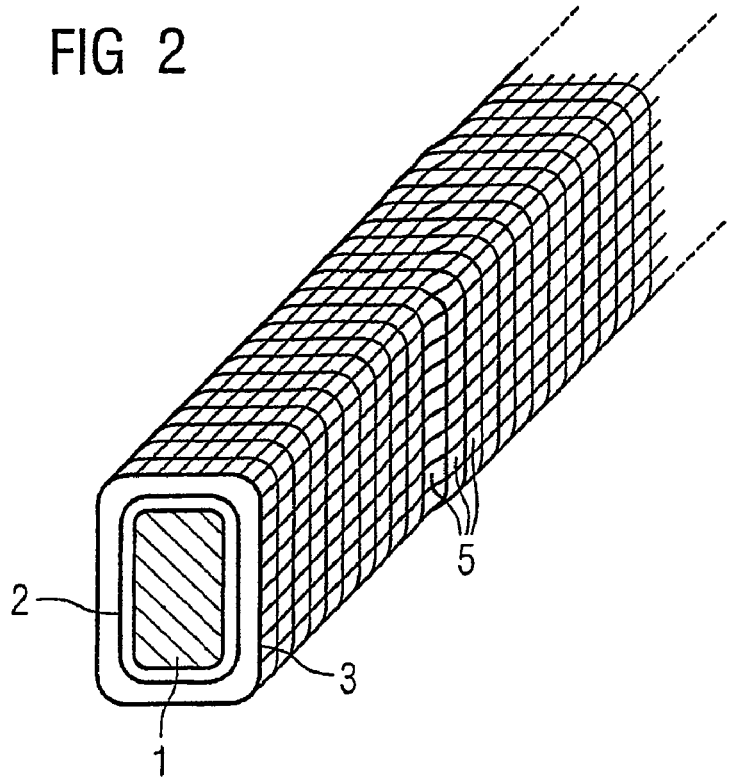
FIG. 2 shows an identical illustration of one end of another conductor according to the invention, and FIG. 3 again shows a perspective illustration of a further exemplary embodiment of a conductor according to the invention.

Another embodiment of the invention is illustrated in FIG. 2. A conductor 1 is again shown having a sheathing which comprises an inner layer 2 and an outer layer 3. As a deviation from the exemplary embodiment described previously, the outer layer 3 of the sheathing is in this case formed by a nylon net, which has meshes 5 having a diameter of approximately 8 mm and as a result brings about a similar effect causing the cooling liquid which is flowing to swirl.

A further exemplary embodiment of the invention is finally depicted in FIG. 3, in which again an actual conductor 1 and an inner layer 2 and an outer layer 3 are shown. As in the example described initially, the outer layer 3 in this case is implemented by a paper strip being wound around the conductor 1 and the inner layer 2 lying therebeneath, this paper strip in this case having an edge with slits at regular intervals instead of a perforation. As a result, this edge forms protruding lugs 6. The outer layer 3 has frayed sections with these lugs 6, and these frayed sections in turn result in the formation of turbulence in a cooling liquid which is flowing past.

Figure 3:
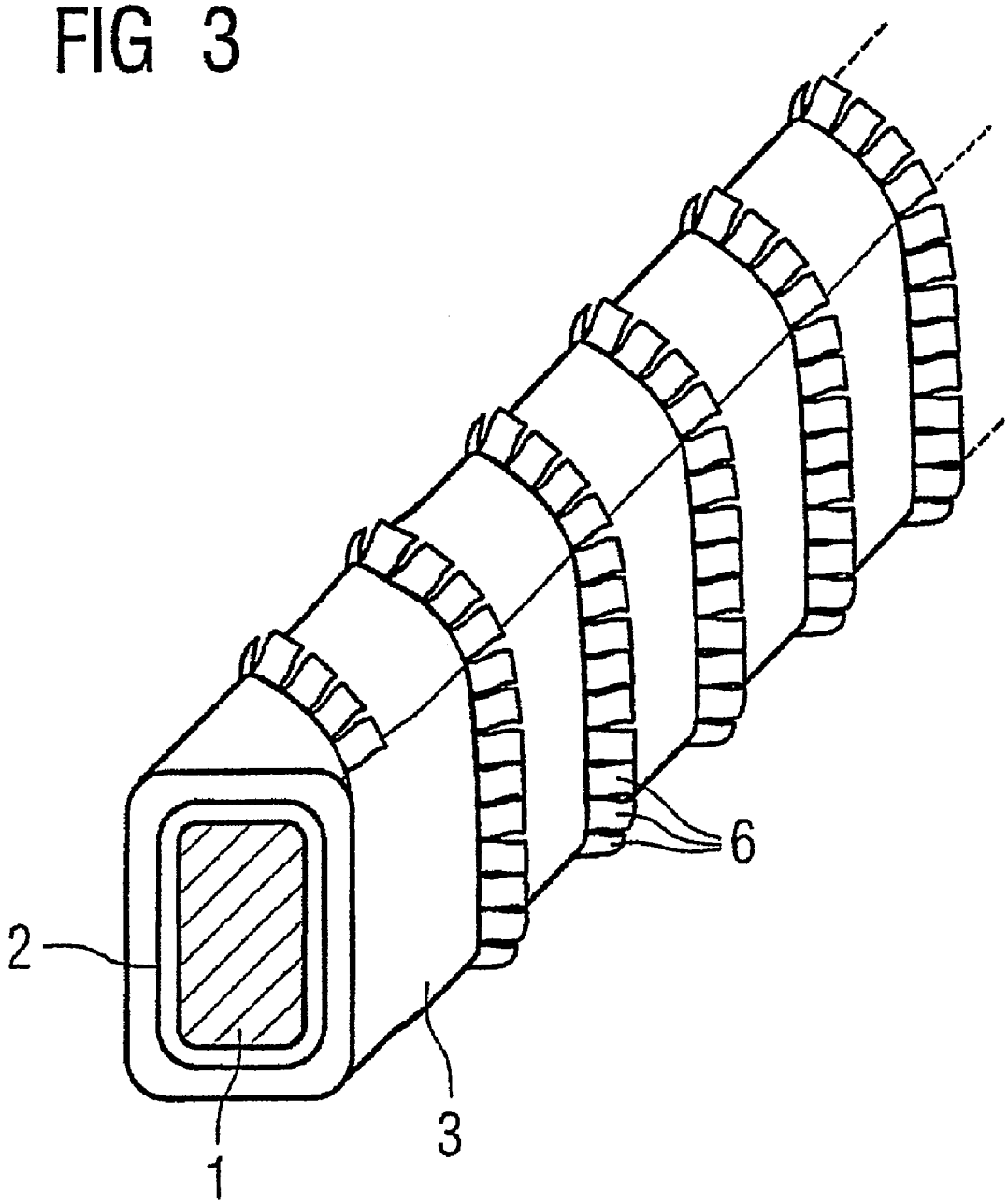

The conductors depicted in FIGS. 1 to 3 are equally also suitable for use in liquid-cooled inductor coils or similar electrical devices having liquid-cooled windings.

The invention claimed is:

1. A conductor for liquid-cooled windings comprising an insulating sheathing which has at least two layers and surrounds the conductor as a whole, wherein an inner layer of said at least two layers surrounds the conductor so as to cover it completely, and wherein an outer layer of said at least two layers has frayed sections.

2. A conductor according to claim 1, wherein at least one of the layers of the sheathing is formed by being wound around the conductor.

3. A conductor according to claim 1, wherein at least one of the layers of the sheathing is made from paper.

4. A conductor according to claim 1, wherein the outer layer is made from perforated paper.

5. A conductor according to claim 1, wherein the outer layer is formed by a tape which is slit at regular intervals at one edge so as to form lugs protruding at the edge, said tape being made from paper.

6. A conductor according to claim 1, wherein, the inner layer has a thickness of between 0.1 mm and 2 mm, or between 0.2 mm and 1 mm.

7. A conductor according to claim 1, wherein the conductor has a rectangular cross section of between 0.2 $cm^2$ and 40 $cm^2$.

8. A liquid-cooled transformer or liquid-cooled inductor coil containing at least one winding comprising a conductor according to claim 1.

9. A conductor according to claim 1, wherein each layer of the sheathing is formed by being wound around the conductor.

10. A conductor for liquid-cooled transformer windings comprising an insulating sheathing which has at least two layers and surround the conductor, wherein at least an inner layer of said at least two layers of the sheathing completely surround the conductor, and an outer layer of said at least two layers of the sheathing is formed by a tape which is slit at regular intervals at one edge so as to form lugs protruding at the edge, said tape being made from paper.

11. A conductor according to claim 10, wherein at least one of said two layers is formed by being wound around the conductor.

12. A conductor according to claim 10, wherein at least one of said two layers is made from paper.

13. A conductor for liquid-cooled windings comprising an insulating sheathing which has at least two layers and surrounds the conductor as a whole, wherein an inner layer of said at least two layers surrounds the conductor so as to cover it completely, and wherein an outer layer of said at least two layers has is formed by a strip wrapped around the conductor, the strip including slits that form lugs protruding from an edge of the strip.

14. A conductor according to claim 13, wherein the strip is formed from paper.

15. A conductor according to claim 13, wherein the slits are formed at regular intervals along the edge of the strip.

16. A conductor according to claim 13, wherein the conductor has a rectangular cross section.

* * * * *

UNITED STATES PATENT AND TRADEMARK OFFICE

CERTIFICATE OF CORRECTION

PATENT NO. : 7,655,867 B2
APPLICATION NO. : 10/595197
DATED : February 2, 2010
INVENTOR(S) : Michael Schäfer It is certified that error appears in the above-identified patent and that said Letters Patent is hereby corrected as shown below:

Title page, item [30] correct the Foreign Application Priority Data as follows:

Sep. 25, 2003 (DE) ..... 103 45 664

Signed and Sealed this

Fourteenth Day of September, 2010

David J. Kappos

David J. Kappos
*Director of the United States Patent and Trademark Office*